US012742582B2

(12) United States Patent
Vijayan et al.

(10) Patent No.: US 12,742,582 B2
(45) Date of Patent: Sep. 22, 2026

(54) TEMPERATURE REGULATING FEATURES FOR A REFRIGERATOR ICEBOX

(71) Applicant: Haier US Appliance Solutions, Inc., Wilmington, DE (US)

(72) Inventors: Vineeth Vijayan, Louisville, KY (US); Alan Joseph Mitchell, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 140 days.

(21) Appl. No.: 18/806,222

(22) Filed: Aug. 15, 2024

(65) Prior Publication Data

US 2026/0049753 A1 Feb. 19, 2026

(51) Int. Cl.
*F25C 5/182* (2018.01)
*F25C 5/20* (2018.01)

(52) U.S. Cl.
CPC ..... *F25C 5/22* (2018.01); *F25C 5/182* (2013.01); *F25C 2400/10* (2013.01)

(58) Field of Classification Search
CPC ..... F25C 5/22; F25C 5/182
See application file for complete search history.

(56) References Cited

U.S. PATENT DOCUMENTS 3,217,510 A 11/1965 Kniffin et al.
3,308,631 A 3/1967 Kniffin
3,892,105 A 7/1975 Bernard
7,228,702 B2 6/2007 Maglinger et al.
8,109,112 B2 * 2/2012 Smith ..... F25C 5/187 62/344
10,378,806 B2 8/2019 Boarman et al.
11,629,902 B2 * 4/2023 Miller ..... F25C 5/22 62/344
11,959,686 B2 4/2024 Kim et al.
2010/0126202 A1 * 5/2010 Flores ..... F25C 5/182 62/344
2011/0146335 A1 * 6/2011 Jung ..... F25D 23/04 62/441
2014/0150459 A1 * 6/2014 Boarman ..... F25B 21/04 62/344
2015/0137670 A1 * 5/2015 Chikkakalbalu ..... A47F 3/0482 428/192
2017/0241692 A1 * 8/2017 Laible ..... F25C 5/18
2018/0087826 A1 3/2018 Hosamani et al.
(Continued)

FOREIGN PATENT DOCUMENTS

CN 100485292 C 5/2009
JP H04260764 A 9/1992
(Continued)

*Primary Examiner* — Lionel Nouketcha
(74) *Attorney, Agent, or Firm* — Dority & Manning, P.A.

(57) ABSTRACT

An ice making assembly mounted to a door of a refrigerator appliance includes an icebox, an ice maker positioned within the icebox for forming ice cubes, and an ice storage bin positioned below the ice maker. The ice storage bin includes an outer shell defining an inner wall positioned against the door and an outer wall facing a chilled chamber of the refrigerator appliance, and a storage insert positioned within the outer shell, the storage insert defining a storage volume for storing the ice cubes, wherein bin insulation is positioned between the storage insert and an outer wall of the outer shell.

17 Claims, 4 Drawing Sheets

(56) References Cited

U.S. PATENT DOCUMENTS

| | | | | |
|---|---|---|---|---|
| 2020/0363115 | A1* | 11/2020 | Mitchell | F25C 5/22 |
| 2020/0393185 | A1* | 12/2020 | Scalf | F25C 5/22 |
| 2022/0154990 | A1* | 5/2022 | Yao | F25D 21/14 |
| 2025/0283645 | A1* | 9/2025 | Ryu | F25C 5/22 |

FOREIGN PATENT DOCUMENTS

| | | | | |
|---|---|---|---|---|
| JP | 2008275223 | A | 11/2008 | |
| KR | 0139319 | Y1 | 5/1999 | |
| KR | 19990032478 | U | 7/1999 | |
| KR | 200283929 | Y1 | 1/2003 | |
| KR | 20040085596 | A * | 10/2004 | F25C 5/182 |
| KR | 102498724 | B1 | 2/2023 | |

* cited by examiner

TEMPERATURE REGULATING FEATURES FOR A REFRIGERATOR ICEBOX

FIELD OF THE INVENTION

The present subject matter relates generally to refrigerator appliances, and more particularly to door-mounted icemakers and storage bins for refrigerator appliances.

BACKGROUND OF THE INVENTION

Refrigerator appliances generally include a cabinet that defines one or more chilled chambers for receipt of food articles for storage. Typically, one or more doors are rotatably hinged to the cabinet to permit selective access to food items stored in the chilled chamber. Further, refrigerator appliances commonly include ice making assemblies mounted within an icebox on one of the doors or in a freezer compartment. The ice is stored in a storage bin and is accessible from within the freezer chamber or may be discharged through a dispenser recess defined on a front of the refrigerator door.

It may be desirable to place craft icemakers on the freezer door for forming craft ice cubes, which are typically large cubes made by a conventional twist tray icemaker. Ideally, such an icemaker reliably produces high quality ice if the ambient temperature is maintained at a temperature elevated relative to the typical freezer compartment in which the icebox is located. Maintaining temperatures above this level may produce high-quality cubes with no cracks or surface bumps. In addition, these cubes may be easy to release from the icemaker mold. However, due to their positioning within the freezer compartment, door-mounted craft icemakers are typically maintained at too low a temperature, resulting in poor ice quality, poor harvest reliability, and consumer dissatisfaction. Moreover, the large craft ice cubes are commonly stored in a cold freezer (e.g., at temperatures between −6° and 6° Fahrenheit) and are prone to cracking when added to room temperature drinks during consumption (e.g., due to thermal shock). While heating elements may be used to regulate the temperature of the ice storage bin, this would result in added costs and complexity and increase energy usage.

Accordingly, a refrigerator appliance with features for improved ice making would be desirable. More particularly, a refrigerator appliance with a door-mounted craft icemaker and storage bin that is maintained at a temperature to produce high quality craft ice would be particularly beneficial.

BRIEF DESCRIPTION OF THE INVENTION

Aspects and advantages of the invention will be set forth in part in the following description, may be apparent from the description, or may be learned through practice of the invention.

In one exemplary embodiment, a refrigerator appliance defining a vertical direction, a lateral direction, and a transverse direction is provided, including a cabinet defining a chilled chamber, a door being rotatably mounted to the cabinet to provide selective access to the chilled chamber, the door at least partially defining an icebox, an ice making assembly positioned within the icebox for forming ice cubes, and an ice storage bin positioned below the ice making assembly and defining a storage volume for storing the ice cubes, wherein the ice storage bin defines an inner wall positioned against the door and an outer wall facing the chilled chamber, and wherein bin insulation is positioned between the storage volume and the outer wall of the ice storage bin.

In another exemplary embodiment, an ice making assembly mounted to a door of a refrigerator appliance. The ice making assembly includes an icebox, an ice maker positioned within the icebox for forming ice cubes, and an ice storage bin positioned below the ice maker. The ice storage bin including an outer shell defining an inner wall positioned against the door and an outer wall facing a chilled chamber of the refrigerator appliance and a storage insert positioned within the outer shell, the storage insert defining a storage volume for storing the ice cubes, wherein bin insulation is positioned between the storage insert and an outer wall of the outer shell.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
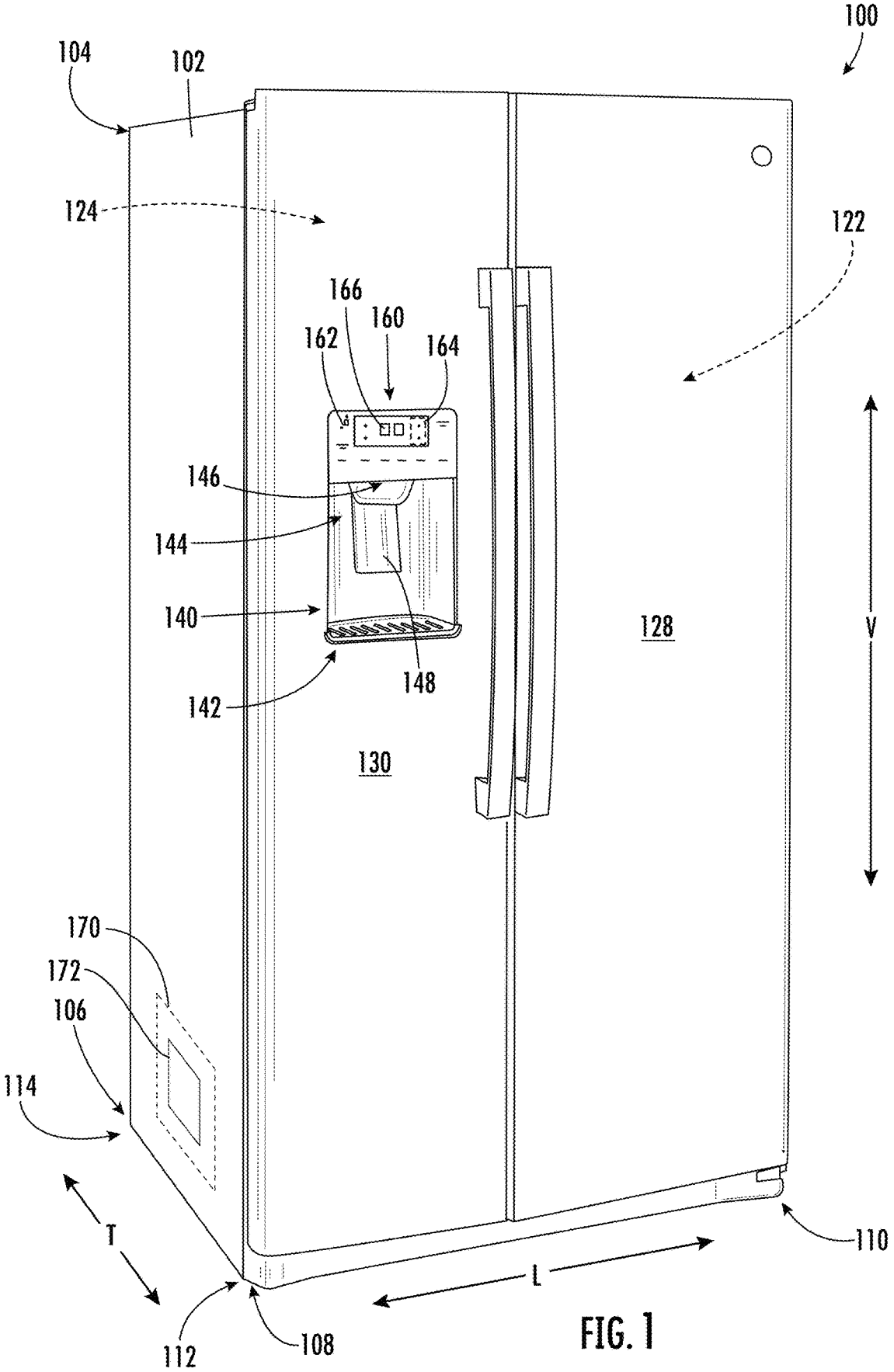
FIG. 1 provides a perspective view of a refrigerator appliance according to an example embodiment of the present subject matter.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms “first,” “second,” and “third” may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). The term "at least one of" in the context of, e.g., "at least one of A, B, and C" refers to only A, only B, only C, or any combination of A, B, and C. In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As explained herein, aspects of the present subject matter are generally directed to a refrigerator that includes a craft ice maker. A thermal insulation pad (with higher thermal conductivity than the regular insulation) may be inserted inside a wall adjacent to the ice maker. The thermal insulation pad may be formed from expanded polystyrene (EPS), providing higher heat leakage into an ice making chamber, raising the temperature of the ice making chamber and slowing the ice making process. Additionally, the ice maker cover may include insulation that aids in increasing the ice maker temperature and acts as an additional thermal resistance to offset the heat leak from the external wall with reduced insulation from reaching the freezer. This may minimize the energy impact and eliminates the chance of sweating/condensation on the outer wall. Further, providing the thermal insulation pad may provide higher temperature in the ice making chamber without the use of heaters, without the need for changing the door/case or foaming tools, and without significant impact on energy consumption.

In addition, aspects of the present subject matter are generally directed to a craft ice maker with an ice bucket insulated from the freezer to provide higher temperature in the ice storage bucket, which prevents ice from cracking when it is added to a room temperature drinks/beverages. For example, the side adjacent to a wall is not insulated to allow heat leak from the outside the appliance to enter the ice bucket easily. The ice bucket may be insulated (e.g., with EPS or polyurethane foam) and installed in a freezer such that it maintains a higher temperature inside the ice bucket than in the freezer. Additionally, the insulation may also be provided on the ice maker cover to aid in increasing the ice maker and ice bucket temperatures. The insulation provided on the ice bucket and ice maker cover may increase temperature in the ice storage bucket without the use of heaters and without any impact on energy consumption.

FIG. 1 provides a perspective view of a refrigerator appliance 100 according to an exemplary embodiment of the present subject matter. Refrigerator appliance 100 includes a cabinet or housing 102 that extends between a top 104 and a bottom 106 along a vertical direction V, between a first side 108 and a second side 110 along a lateral direction L, and between a front side 112 and a rear side 114 along a transverse direction T. Each of the vertical direction V, lateral direction L, and transverse direction T are mutually perpendicular to one another.

Housing 102 defines chilled chambers for receipt of food items for storage. In particular, housing 102 defines fresh food chamber 122 positioned at or adjacent second side 110 of housing 102 and a freezer chamber 124 arranged at or adjacent first side 108 of housing 102. As such, refrigerator appliance 100 is generally referred to as a side-by-side refrigerator. It is recognized, however, that the benefits of the present disclosure apply to other types and styles of refrigerator appliances such as, e.g., a top mount refrigerator appliance, a bottom mount refrigerator appliance, or a single door refrigerator appliance. Consequently, the description set forth herein is for illustrative purposes only and is not intended to be limiting in any aspect to any particular refrigerator chamber configuration.

A refrigerator door 128 is rotatably hinged to an edge of housing 102 for selectively accessing fresh food chamber 122. In addition, a freezer door 130 is rotatably hinged to an edge of housing 102 for selectively accessing freezer chamber 124. Refrigerator door 128 and freezer door 130 are shown in the closed configuration in FIG. 1. One skilled in the art will appreciate that other chamber and door configurations are possible and within the scope of the present invention.

Figure 2:
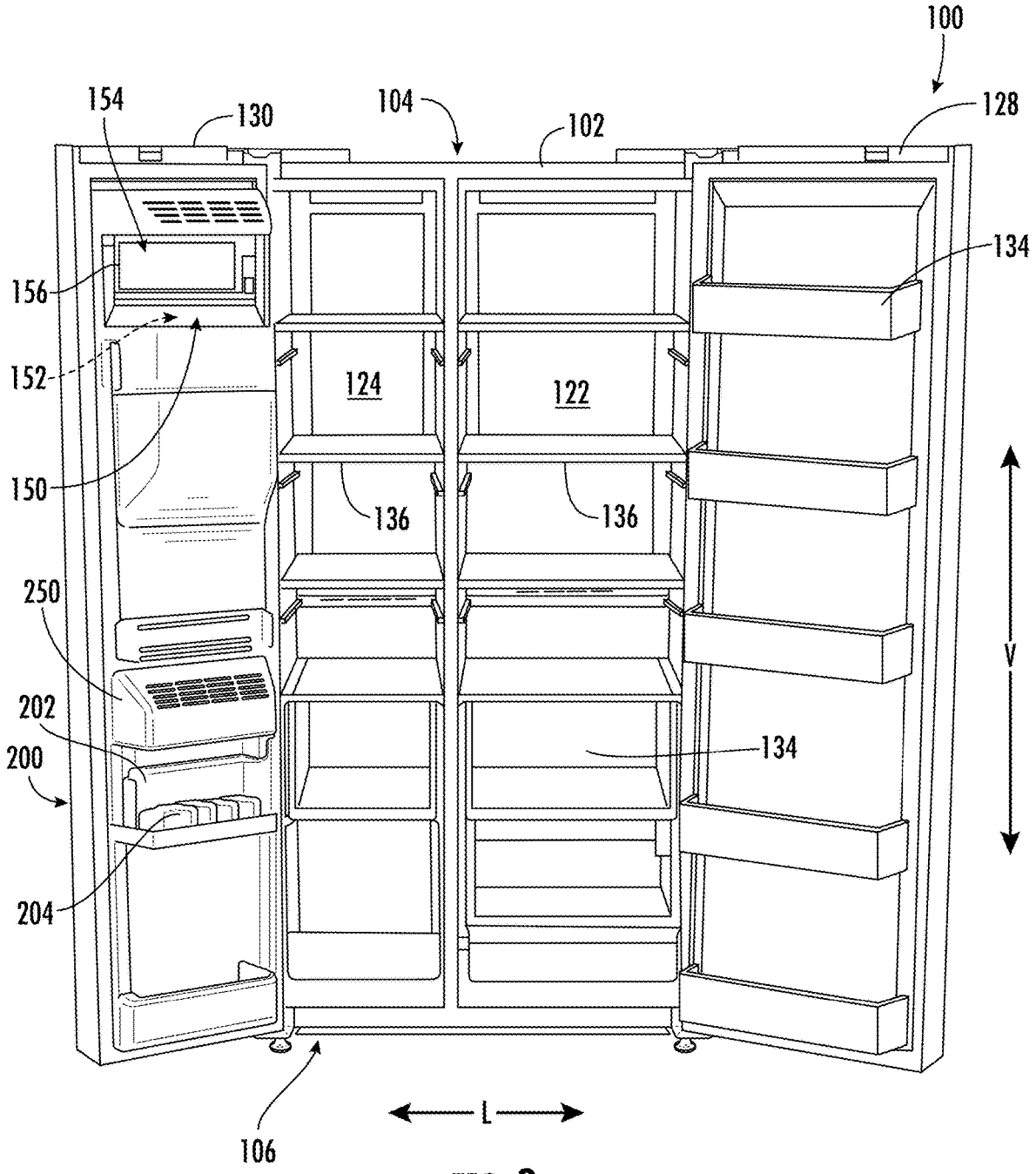
FIG. 2 provides a front view of the example refrigerator appliance of FIG. 1, with the doors of the fresh food chamber and freezer chamber shown in an open position.

FIG. 2 provides a front view of refrigerator appliance 100 shown with refrigerator door 128 and freezer door 130 in the open position. As shown in FIG. 2, various storage components are mounted within fresh food chamber 122 to facilitate storage of food items therein as will be understood by those skilled in the art. In particular, the storage components may include bins 134 and shelves 136. Each of these storage components are configured for receipt of food items (e.g., beverages and/or solid food items) and may assist with organizing such food items. As illustrated, bins 134 may be mounted on refrigerator door 128 and freezer door 130 or may slide into a receiving space in fresh food chamber 122 or freezer chamber 124. It should be appreciated that the illustrated storage components are used only for the purpose of explanation and that other storage components may be used and may have different sizes, shapes, and configurations.

Referring now generally to FIG. 1, a dispensing assembly 140 will be described according to exemplary embodiments of the present subject matter. Dispensing assembly 140 is generally configured for dispensing liquid water and/or ice. Although an exemplary dispensing assembly 140 is illustrated and described herein, it should be appreciated that variations and modifications may be made to dispensing assembly 140 while remaining within the present subject matter.

Dispensing assembly 140 and its various components may be positioned at least in part within a dispenser recess 142 defined on freezer door 130. In this regard, dispenser recess 142 is defined on a front side 112 of refrigerator appliance 100 such that a user may operate dispensing assembly 140 without opening freezer door 130. In addition, dispenser recess 142 is positioned at a predetermined elevation convenient for a user to access ice and enabling the user to access ice without the need to bend-over. In the exemplary embodiment, dispenser recess 142 is positioned at a level that approximates the chest level of a user.

Dispensing assembly 140 includes an ice dispenser 144 including a discharging outlet 146 for discharging ice from dispensing assembly 140. An actuating mechanism 148, shown as a paddle, is mounted below discharging outlet 146 for operating ice or water dispenser 144. In alternative exemplary embodiments, any suitable actuating mechanism may be used to operate ice dispenser 144. For example, ice dispenser 144 can include a sensor (such as an ultrasonic sensor) or a button rather than the paddle. Discharging outlet 146 and actuating mechanism 148 are an external part of ice dispenser 144 and are mounted in dispenser recess 142.

Referring again to FIG. 2, inside refrigerator appliance 100, freezer door 130 may include an icebox 150 that generally includes one or more icemakers and ice storage bins 152 that are configured to form ice. In this regard, for example, icebox 150 may define an ice making chamber 154 for housing ice making assemblies, storage mechanisms, and dispensing mechanisms. According to the illustrated embodiment, icebox 150 may include dispensing assembly 140 and may have a primary ice making assembly 156. In addition, icebox 150 may include an icemaker for forming "craft ice" that is commonly large, clear cubes or spheres of ice for alcoholic or non-alcoholic drinks. For example, a user may access this craft ice by opening freezer door 130 and accessing storage bin 152 directly.

A control panel 160 is provided for controlling the mode of operation. For example, control panel 160 includes one or more selector inputs 162, such as knobs, buttons, touch-screen interfaces, etc., such as a water dispensing button and an ice-dispensing button, for selecting a desired mode of operation such as crushed or non-crushed ice. In addition, inputs 162 may be used to specify a fill volume or method of operating dispensing assembly 140. In this regard, inputs 162 may be in communication with a processing device or controller 164. Signals generated in controller 164 operate refrigerator appliance 100 and dispensing assembly 140 in response to selector inputs 162. Additionally, a display 166, such as an indicator light or a screen, may be provided on control panel 160. Display 166 may be in communication with controller 164 and may display information in response to signals from controller 164.

As used herein, "processing device" or "controller" may refer to one or more microprocessors or semiconductor devices and is not restricted necessarily to a single element. The processing device can be programmed to operate refrigerator appliance 100 and dispensing assembly 140. The processing device may include, or be associated with, one or more memory elements (e.g., non-transitory storage media). In some such embodiments, the memory elements include electrically erasable, programmable read only memory (EEPROM). Generally, the memory elements can store information accessible processing device, including instructions that can be executed by processing device. Optionally, the instructions can be software or any set of instructions and/or data that when executed by the processing device, cause the processing device to perform operations.

Referring again briefly to FIG. 1, according to an exemplary embodiment, cabinet 102 also defines a mechanical compartment 170 at or near the bottom 106 of the cabinet 102 for receipt of a hermetically sealed cooling system 172. In general, sealed cooling system 172 is configured for transporting heat from the inside of refrigerator appliance 100 to the outside (e.g., by executing a vapor-compression cycle or another suitable refrigeration cycle). As is generally understood by those of skill in the art, the hermetically sealed system 172 contains a working fluid, e.g., refrigerant, which flows between various heat exchangers of the sealed system 172 where the working fluid changes phases while transferring thermal energy.

In this regard, as understood by one having ordinary skill in the art, sealed system 172 may include a compressor, a condenser, an expansion device, and one or more evaporators connected in series by a fluid conduit that is charged with a refrigerant. Within sealed system 172, refrigerant flows into the compressor, which operates to increase the pressure of the refrigerant. This compression of the refrigerant raises its temperature, which is lowered by passing the refrigerant through the condenser. Within the condenser, heat exchange with ambient air takes place so as to cool the refrigerant. A condenser fan may be used to pull air across the condenser, so as to provide forced convection for a more rapid and efficient heat exchange between the refrigerant within the condenser and the ambient air. Thus, as will be understood by those skilled in the art, increasing air flow across the condenser can, e.g., increase the efficiency of the condenser by improving cooling of the refrigerant contained therein.

An expansion device (e.g., an electronic expansion valve, capillary tube, or other restriction device) receives refrigerant from the condenser. From the expansion device, the refrigerant enters the evaporator. Upon exiting the expansion device and entering the evaporator, the refrigerant drops in pressure. Due to the pressure drop and/or phase change of the refrigerant, the evaporator is relatively cool. An evaporator fan is typically provided at each the evaporator, e.g., to force air across and around the at least one evaporator to transfer thermal energy from the air to the evaporator (and more particularly, to the working fluid or refrigerant therein).

In this manner, a flow of cooling air exits the evaporator and may be distributed to one or more of the chilled chambers 122 and/or 124. Specifically, one or more ducts may extend between the mechanical compartment 170 and the chilled chambers 122 and/or 124 to provide fluid communication therebetween, e.g., to provide the chilled air from the hermetically sealed cooling system 172, e.g., from an evaporator thereof, to one or more of the chilled chambers 122 and/or 124.

The sealed system 172 described herein is provided by way of example only. Thus, it is within the scope of the present subject matter for other configurations of the refrigeration system to be used as well. For example, according to alternative embodiments, sealed system 172 may include additional components, e.g., at least one additional evaporator, compressor, expansion device, and/or condenser. For example, refrigerator appliance 100 may have two or more split evaporators, e.g., one dedicated primarily to cooling fresh food chamber 122 and one dedicated primarily to cooling freezer chamber 124. In addition, alternative plumbing configurations, valves, and flow regulators may be used to route refrigerant throughout sealed system 172.

According to the illustrated embodiments, refrigerator appliance 100 may include a primary, upper ice making assembly 156 (e.g., a main icemaker associated with dispensing assembly 140 for discharging ice through ice dispenser 144) and an auxiliary, lower ice making assembly 200 (e.g., a secondary icemaker such as a craft icemaker). According to example embodiments, each of primary ice making assembly 156 and auxiliary ice making assembly 200 are mounted to freezer door 130, e.g., within icebox 150. According to example embodiments, each of primary ice making assembly 156 and auxiliary ice making assembly 200 may have a dedicated storage bin for storing ice (e.g., such as storage bin 152). In addition, according to an example embodiment, primary ice making assembly 156 may include a dispensing type of bucket and motor that would supply ice to discharging outlet 146 of dispensing assembly 140 (or alternatively could include an ice storage bin with no external dispenser). By contrast, auxiliary ice making assembly 200 may include an ice storage bin 202 that has no dispensing system, as described in more detail below.

Referring now generally to FIGS. 2 through 5, ice storage bin 202 may be mounted on freezer door 130 below auxiliary ice making assembly 200 for storing craft ice 204 formed therein. In this regard, auxiliary ice making assembly 200 is positioned above the door-mounted ice storage bin 202 such that harvested ice 204 may fall from auxiliary ice making assembly 200 into the door-mounted ice storage bin 202. Notably, as explained briefly above, if craft ice 204 is maintained at a typical freezer temperature, the thermal shock experienced when placed in drinks may cause the craft ice 204 to crack, resulting in user dissatisfaction and perceived lower quality. Accordingly, aspects of the present subject matter are directed to ice making assemblies and storage bins including thermal management features for forming and maintaining craft ice 204 at a slightly elevated temperature relative to freezer chamber 124.

According to the illustrated embodiment, ice storage bin 202 defines a storage volume 210 for receiving and storing craft ice 204. For example, ice storage bin 202 may include an outer shell 212 and a storage insert 214 positioned within outer shell 212, where storage insert 214 defines storage volume 210. More specifically, outer shell 212 may be defined by an outer wall 216 (e.g., positioned within or facing freezer chamber 124), an inner wall 218 (e.g., seated on an inner panel of freezer door 130), two sidewalls 220, and a bottom wall 222. Similarly, storage insert 214 may be defined by an outer wall 224 (e.g., positioned within or facing freezer chamber 124), an inner wall 226 (e.g., seated proximate inner wall 218 of outer shell 212), two sidewalls 228, and a bottom wall 230. Storage insert 214 may be positioned within outer shell 212 to define an open-top and storage volume 210.

According to an example embodiment, bin insulation 240 may be positioned between storage volume 210 and outer wall 216 of outer shell 212 or ice storage bin 202. According to example embodiments, bin insulation 240 may also be positioned along sidewalls 228 and bottom wall 230 of storage insert 214. In this manner, storage volume 210 may be at least partially thermally insulated from the cooler temperatures within freezer chamber 124, such that craft ice 204 contained therein may be kept at a temperature that is below freezing but not so cold as to cause cracking due to thermal shock when dispensed into a cocktail or beverage. For example, conventional freezer temperatures hover around 0° F., whereas desired temperature for forming and storing craft ice of high quality may be between about 15° F. and 20° F.

Notably, in order to receive some heat from outside of freezer chamber 124, freezer door 130 and ice storage bin 202 may be designed to provide lower thermal insulation to the ambient environment. For example, inner wall 226 of storage insert 214 may be positioned directly against inner wall 218 of outer shell 212. Moreover, these walls may be in direct contact with little or no bin insulation positioned therebetween. In this manner, a heat path may be defined through freezer door 130 and directly into storage volume 210, thereby resulting in a higher storage temperature than that of freezer chamber 124.

It should be appreciated that bin insulation 240 may be formed from any suitable material and may be applied in any suitable form. For example, bin insulation 240 may include at least one of polyurethane or expanded polystyrene. In addition, bin insulation 240 may be provided as foam blocks or filler, spray foam, insulating pads, block insulation, or any other suitable form of insulation. It should be appreciated that variations and modifications may be made to structure and configuration of ice storage bin 202 while remaining within the scope of the present subject matter.

Figure 3:
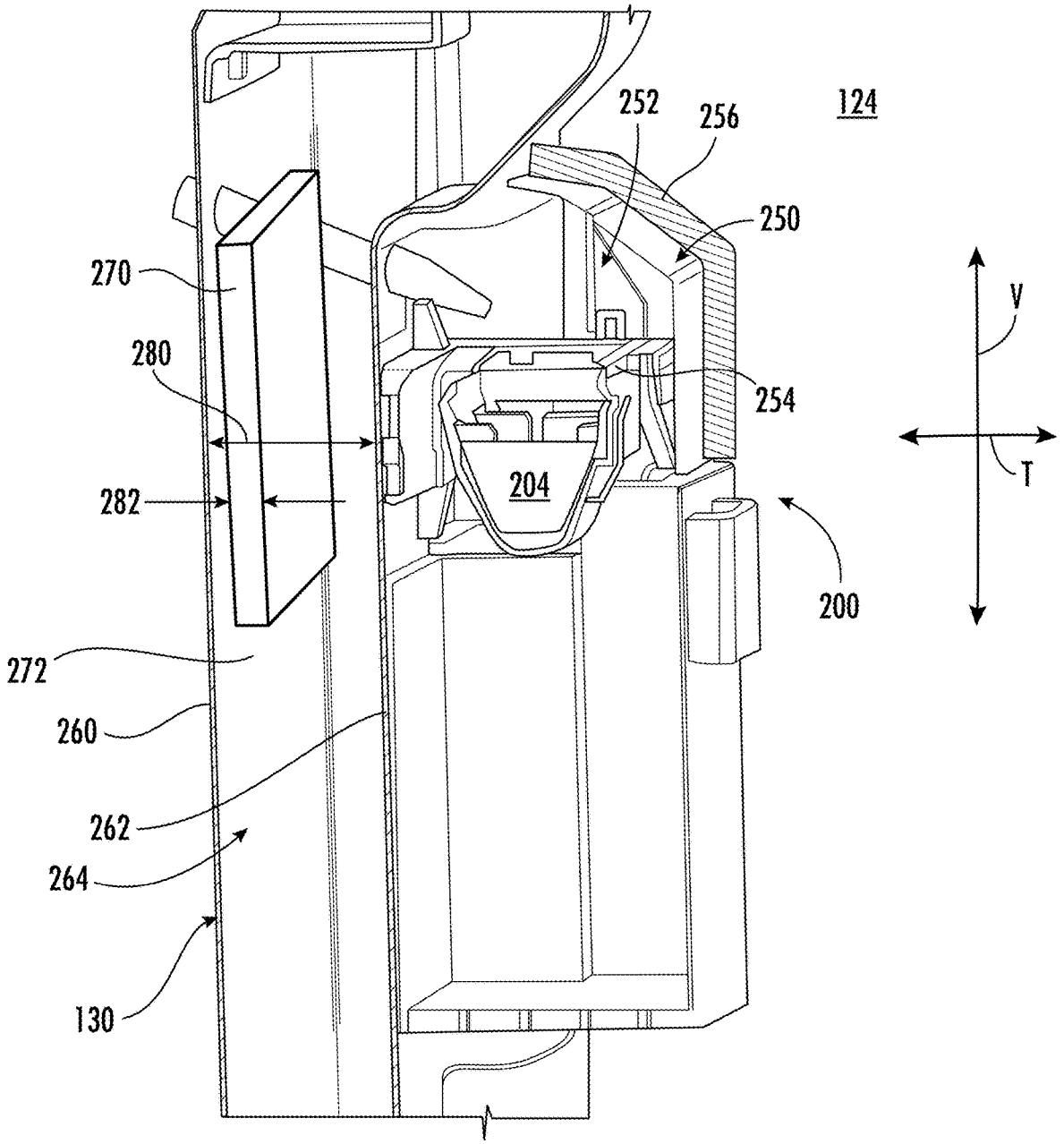
FIG. 3 provides cross-sectional view of an ice making assembly of the example refrigerator appliance of FIG. 1 according to an example embodiment of the present subject matter.
Figure 4:
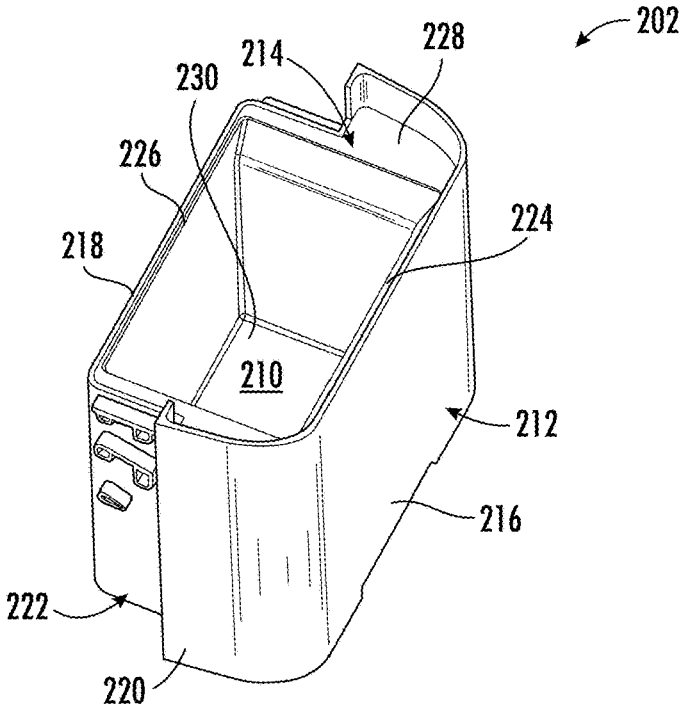
FIG. 4 provides a perspective view of an ice storage bin of the example ice making assembly of FIG. 3 according to an example embodiment of the present subject matter.
Figure 5:
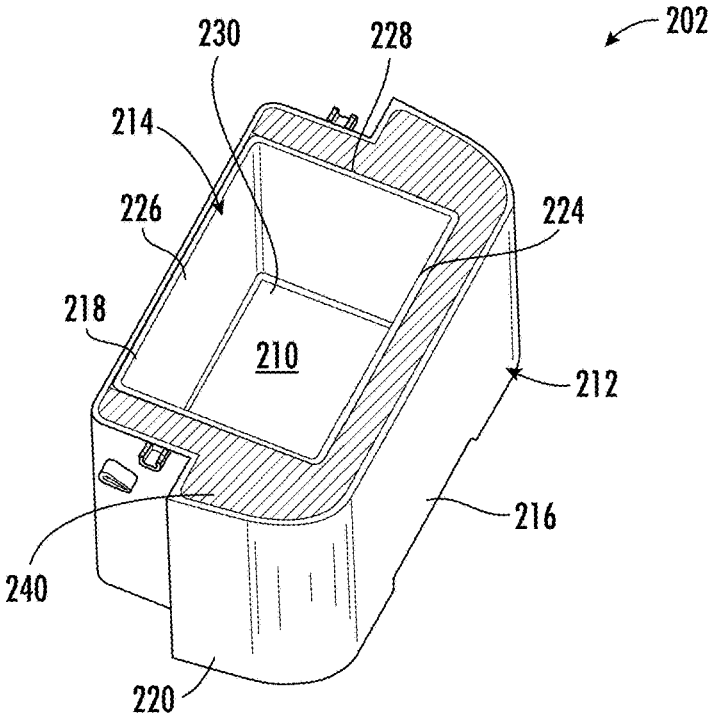
FIG. 5 provides a cross-sectional view of the example ice storage bin of FIG. 4 according to an example embodiment of the present subject matter.

As shown for example in FIG. 3, auxiliary ice making assembly 200 may include an ice maker housing 250 that defines an ice making volume 252. In general, ice making housing 250 may be positioned above ice storage bin 202 and may include an auxiliary ice maker 254 (e.g., a "craft ice" maker) positioned within ice making volume 252. Auxiliary ice making assembly 200 may include features to facilitate formation and storage of craft ice 204 at a higher temperature than the temperature of freezer chamber 124. For example, there may be few to no openings into auxiliary ice making assembly 200 or the openings may be carefully regulated (e.g., via dampers) to regulate the temperature of ice making volume 252 and/or storage volume 210. According to the illustrated embodiment, auxiliary ice making assembly 200 may include an insulated cover 256 positioned over ice maker housing 250 for providing further thermal isolation between ice making volume 252 and freezer chamber 124. For example, insulated cover 256 may be an insulated pad positioned on ice maker housing 250 or the walls of ice maker housing 250 may be formed at a specific thickness or with a particular material to achieve the desired level of thermal insulation.

Referring now specifically to FIG. 3, ice storage bin 202 may generally be positioned on or defined by freezer door 130. In this regard, freezer door 130 may generally have an outer door panel 260 and an inner door panel 262 that are spaced apart along the transverse direction by a door gap 264. For example, door gap 264 may be filled with one or more insulating materials. The door gap of conventional freezer doors may have a single layer of insulating material having constant thermal conductivity. While this thermal conductivity and insulation factor may be desirable for maintaining the lower temperature of freezer chamber 124, it may not be suitable for achieving desirable temperatures in ice storage bin 202 or ice making volume 252 (e.g., temperatures higher than the temperature of freezer chamber 124). Accordingly, as will be described in more detail below, the insulation of freezer door 126 may be varied proximate auxiliary ice making assembly 200, e.g., such that improved thermal transfer between the ambient environment and ice storage bin 202 or ice making volume 252 may be achieved.

Specifically, referring to FIG. 3, freezer door 130 may generally include a first insulating material 270 positioned within door gap 264 and having a first thermal conductivity and a second insulating material 272 positioned within door gap 264 and having a second thermal conductivity. According to an example embodiment, the second thermal conductivity may be lower than the first thermal conductivity, e.g., by greater than 20%, 40%, 60%, or greater. According to an example embodiment, first insulating material 270 is an insulating pad, insulating foam, or an expanded polystyrene block and second insulating material 272 is sprayed polyurethane foam surrounding first insulating material 270. In this regard, for example, sprayed polyurethane foam may be injected into door gap 264 along the entirety of freezer door 130. However, by first placing first material 270 (having a higher thermal conductivity) in the door adjacent to auxiliary ice making assembly 200, the effective thermal insulation within that region of freezer door 130 may be controlled to facilitate desired temperatures within auxiliary ice making assembly 200.

Notably, the thickness, material, and configuration of first insulating material 270 and second insulating material 272 may be varied to get the desired insulation factor between storage volume 210, ice making volume 252, and the ambient environment. For example, door gap 264 may define a door gap thickness 280 measured along the transverse direction T and first insulating material 270 may define a first thickness 282 measured along the transverse direction T. According to an example embodiment, first thickness 282 is greater than 20%, greater than 30%, greater than 50%, greater than 75%, or greater of door gap thickness 280. In general, the greater the first thickness 282 of first insulating material 270 (which has higher thermal conductivity), the more heat that is obtained from the ambient environment for higher temperatures within storage volume 210 and ice making volume 252.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A refrigerator appliance defining a vertical direction, a lateral direction, and a transverse direction, comprising:
- a cabinet defining a chilled chamber;
- a door being rotatably mounted to the cabinet to provide selective access to the chilled chamber, the door at least partially defining an icebox;
- an ice making assembly positioned within the icebox for forming ice cubes; and
- an ice storage bin positioned below the ice making assembly and defining a storage volume for storing the ice cubes, wherein the ice storage bin defines an inner wall positioned against the door and an outer wall facing the chilled chamber, and wherein bin insulation is positioned between the storage volume and the outer wall of the ice storage bin, and wherein the ice storage bin further comprises an outer shell and a storage insert positioned within the outer shell, the storage insert defining the storage volume, wherein an inner wall of the storage insert is positioned directly against the inner wall of the outer shell along an entire area of the inner wall.

2. The refrigerator appliance of claim 1, wherein the bin insulation is positioned along sidewalls and a bottom wall of the storage insert.

3. The refrigerator appliance of claim 2, wherein there is no insulation between the inner wall of the storage insert and the inner wall of the outer shell.

4. The refrigerator appliance of claim 1, wherein the bin insulation comprises at least one of polyurethane or expanded polystyrene.

5. The refrigerator appliance of claim 1, wherein the ice making assembly further comprises:
- an ice maker housing defining an ice making volume;
- an ice maker positioned within the ice maker housing; and
- an insulated cover positioned over the ice maker housing.

6. The refrigerator appliance of claim 1, wherein the door at least partially defines the icebox and comprises:
- an outer door panel and an inner door panel spaced apart along the transverse direction to define a door gap;
- a first insulating material positioned within the door gap and having a first thermal conductivity; and
- a second insulating material positioned within the door gap and having a second thermal conductivity, the second thermal conductivity being lower than the first thermal conductivity.

7. The refrigerator appliance of claim 6, wherein the first insulating material is an insulating pad, insulating foam, or an expanded polystyrene block.

8. The refrigerator appliance of claim 6, wherein the second insulating material is sprayed polyurethane foam surrounding the first insulating material.

9. The refrigerator appliance of claim 6, wherein the first insulating material defines a first thickness measured along the transverse direction, the door gap defines a door gap thickness, and the first thickness is greater than 30% of the door gap thickness.

10. The refrigerator appliance of claim 1, wherein the chilled chamber is a freezer compartment of the refrigerator appliance.

11. The refrigerator appliance of claim 1, wherein the refrigerator appliance is a side-by-side refrigerator appliance.

12. An ice making assembly mounted to a door of a refrigerator appliance, the ice making assembly comprising:
- an icebox;
- an ice maker positioned within the icebox for forming ice cubes; and
- an ice storage bin positioned below the ice maker and comprising:
  - an outer shell defining an inner wall positioned against the door and an outer wall facing a chilled chamber of the refrigerator appliance; and
  - a storage insert positioned within the outer shell, the storage insert defining a storage volume for storing the ice cubes, wherein bin insulation is positioned between the storage insert and an outer wall of the outer shell, and wherein the inner wall of the storage insert is positioned directly against the inner wall of the outer shell along an entire area of the inner wall.

13. The ice making assembly of claim 12, wherein the bin insulation is positioned along sidewalls and a bottom wall of the storage insert.

14. The ice making assembly of claim 12, wherein the bin insulation comprises at least one of polyurethane or expanded polystyrene.

15. The ice making assembly of claim 12, further comprising:

an ice maker housing defining an ice making volume for receiving the ice maker; and an insulated cover positioned over the ice maker housing.

16. The ice making assembly of claim 12, wherein the door at least partially defines the icebox and comprises:

an outer door panel and an inner door panel spaced apart along a transverse direction to define a door gap;

a first insulating material positioned within the door gap and having a first thermal conductivity; and a second insulating material positioned within the door gap and having a second thermal conductivity, the second thermal conductivity being lower than the first thermal conductivity.

17. The ice making assembly of claim 16, wherein the first insulating material defines a first thickness measured along the transverse direction, the door gap defines a door gap thickness, and the first thickness is greater than 30% of the door gap thickness.

* * * * *